US010369480B2

(12) United States Patent
Hunter

(10) Patent No.: US 10,369,480 B2
(45) Date of Patent: Aug. 6, 2019

(54) WATER SLIDE

(71) Applicant: PROSLIDE TECHNOLOGY INC., Ottawa, Ontario (CA)

(72) Inventor: Richard D. Hunter, Ottawa (CA)

(73) Assignee: PROSLIDE TECHNOLOGY INC., Ottawa (CA)

( * ) Notice: Subject to any disclaimer, the term of this patent is extended or adjusted under 35 U.S.C. 154(b) by 0 days.

(21) Appl. No.: 14/795,042

(22) Filed: Jul. 9, 2015

(65) Prior Publication Data

US 2015/0314203 A1 Nov. 5, 2015

Related U.S. Application Data

(63) Continuation of application No. 13/508,477, filed as application No. PCT/CA2010/001763 on Nov. 12, 2010, now Pat. No. 9,079,111.

(60) Provisional application No. 61/261,101, filed on Nov. 13, 2009.

(51) Int. Cl.
*A63G 21/18* (2006.01)
*A63G 3/00* (2006.01)

(52) U.S. Cl.
CPC ..... *A63G 21/18* (2013.01)

(58) Field of Classification Search
CPC ... A63G 3/00; A63G 7/00; A63G 9/00; A63G 21/00; A63G 21/04; A63G 21/18
USPC ..... 472/13, 116, 117, 128; 104/53, 69, 70
See application file for complete search history.

(56) References Cited

U.S. PATENT DOCUMENTS

| | | | |
|---|---|---|---|
| 4,738,590 | A | 4/1988 | Butler |
| 4,836,521 | A | 6/1989 | Barber |
| 5,137,497 | A | 8/1992 | Dubeta |
| 5,171,101 | A | 12/1992 | Sauerbier et al. |
| 5,236,280 | A | 8/1993 | Lochtefeld |
| 5,271,692 | A | 12/1993 | Lochtefeld |
| 5,393,170 | A | 2/1995 | Lochtefeld |
| 5,401,117 | A | 3/1995 | Lochtefeld |
| 5,421,782 | A | 6/1995 | Lochtefeld |
| 5,564,859 | A | 10/1996 | Lochtefeld |
| 5,628,584 | A | 5/1997 | Lochtefeld |
| 5,738,590 | A | 4/1998 | Lochtefeld et al. |
| 5,766,082 | A | 6/1998 | Lochtefeld et al. |
| 5,779,553 | A | 7/1998 | Langford |

(Continued)

FOREIGN PATENT DOCUMENTS

| | | |
|---|---|---|
| CA | 2 090 878 | 3/1992 |
| CA | 2 328 339 | 12/2001 |

(Continued)

OTHER PUBLICATIONS

European Extended Search Report for EP 10829405.9, dated Apr. 24, 2013.

(Continued)

*Primary Examiner* — Kien T Nguyen
(74) *Attorney, Agent, or Firm* — Finnegan, Henderson, Farabow, Garrett & Dunner, L.L.P.

(57) ABSTRACT

A water slide feature comprising a sliding surface concave about three axes. The waterslide feature is sized and adapted to carry one or more riders and/or ride vehicles sliding thereon on anon-predetermined path. The water slide feature has an entry sized and positioned to direct the one or more riders and/or ride vehicles along the sliding surface on a path which is at least partially upward.

15 Claims, 9 Drawing Sheets

(56) References Cited

U.S. PATENT DOCUMENTS

| | | | | |
|---|---|---|---|---|
| 5,899,633 | A | 5/1999 | Lochtefeld | |
| 6,132,317 | A | 10/2000 | Lochtefeld | |
| 6,319,137 | B1 | 11/2001 | Lochtefeld | |
| 6,354,955 | B1 | 3/2002 | Stuart et al. | |
| 6,450,891 | B1 | 9/2002 | Dubeta | |
| 6,485,372 | B2 | 11/2002 | Stuart et al. | |
| 6,491,589 | B1 | 12/2002 | Lochtefeld | |
| 6,716,107 | B2 | 4/2004 | Lochtefeld | |
| 6,743,107 | B2 | 6/2004 | Dubeta | |
| 6,857,964 | B2 | 2/2005 | Hunter | |
| D521,098 | S | 5/2006 | Hunter | |
| 7,056,220 | B2 | 6/2006 | Hunter | |
| D548,810 | S | 8/2007 | Hunter | |
| D567,322 | S | 4/2008 | Hunter | |
| D583,895 | S | 12/2008 | Hlynka | |
| 8,197,353 | B2 | 6/2012 | Brassard | |
| 8,579,715 | B2 * | 11/2013 | Olive | A63G 21/18 472/116 |
| D697,159 | S * | 1/2014 | Altindag | D21/819 |
| D706,892 | S * | 6/2014 | Altindag | D21/819 |
| 2005/0047869 | A1 | 3/2005 | Lochtefeld | |
| 2005/0075180 | A1 | 4/2005 | Dubeta | |
| 2006/0194638 | A1 | 8/2006 | Hunter | |
| 2008/0153610 | A1 | 6/2008 | Braun et al. | |
| 2009/0062025 | A1 | 3/2009 | Hlynka | |
| 2009/0221377 | A1 | 9/2009 | Hlynka | |

FOREIGN PATENT DOCUMENTS

| | | |
|---|---|---|
| CA | 2 639 347 | 2/2009 |
| CA | 2 656 749 | 8/2009 |
| CN | 101417179 | 4/2009 |
| GB | 2 224 948 | 5/1990 |
| WO | WO 01/24899 A1 | 4/2001 |

OTHER PUBLICATIONS

Search Report, issued in connection with PCT/CA2010/001763, from the ISA/CA dated Jan. 27, 2011.

Communication pursuant to Article 94(3), Application No. EP 10 829 405.9, issued from the European Patent Office dated Jun. 21, 2016.

* cited by examiner

WATER SLIDE

CROSS-REFERENCE TO RELATED APPLICATIONS

This is a continuation of application Ser. No. 13/508,477 filed Jul. 5 2015, which is a U.S. national counterpart application of international application Ser. No. PCT/CA2010/001763, filed Nov. 12, 2010, which claims priority to U.S. Provisional Application No. 61/261,101, filed Nov. 13, 2009 all of which are incorporated herein by reference.

FIELD

The invention relates in general to water slide rides, and more particularly, to a water slide ride having a concave slide feature.

BACKGROUND

Water slides are popular ride attractions for water parks, theme parks, family entertainment centers and destination resorts. Water slides not only offer welcome relief from the summer heat, they also provide an exciting and entertaining diversion from conventional pool and/or ocean bathing activities.

In one type of water slide, a bather or rider slides his body and/or a flexible riding mat, tube or raft ("ride vehicle") along a downward-inclined sliding surface defined by a flume or water channel that bends, twists and turns following a predetermined ride path. The flume also typically carries a flow of water from a starting pool at some desired higher elevation to a landing pool or run-out at a desired lower elevation. The water is typically continuously recirculated from the lower elevation to the higher elevation using one or more pumps and then continuously falls with gravity from the higher elevation to the lower elevation flowing along the slide/flume path. The water provides cooling fun for the ride participants, and also provides a lubricious film or fluid between the rider/vehicle and the ride surface so as to increase the speed of the rider down the flume path.

The popularity of water slides has increased dramatically over the years, as they have proliferated and evolved into ever larger and more exciting rides. Nevertheless, park patrons continue to demand and seek out more and more exciting and stimulating ride experiences. Thus, there is an ever present demand and need for different and more exciting water slide designs that offer riders a new and unique ride experience and that give park owners the ability to draw larger and larger crowds to their parks.

SUMMARY

According to one aspect of the present invention, there is provided a water slide feature comprising a sliding surface concave about three axes sized and adapted to carry one or more riders and/or ride vehicles sliding thereon on a non-predetermined path, an entry sized and positioned to direct the one or more riders and/or ride vehicles along the sliding surface on a path which is at least partially upward.

According to another aspect of the present invention, there is provided a water slide feature comprising a concave sliding surface sized and adapted to carry one or more riders and/or ride vehicles sliding thereon on a non-predetermined path, an entry sized and positioned to direct the one or more riders and/or ride vehicles upward along the sliding surface in a continuously curved path of more than 180 degrees around a center point on the sliding surface from which the sliding surface curves outward.

According to still another aspect of the present invention, there is provided a water slide feature comprising a concave sliding surface sized and adapted to carry one or more riders and/or ride vehicles sliding there on an non-predetermined path, an entry sized and positioned to direct the one or more riders and/or ride vehicles along the sliding surface in a looping path around the sliding surface and out an exit adjacent to the entry.

According to yet another aspect of the present invention, there is provided a water slide feature comprising a concave sliding surface sized and adapted to carry one or more riders and/or ride vehicles sliding thereon on a non-predetermined path, an entry sized and positioned to direct the one or more riders and/or ride vehicles along the sliding surface on a path having a first path segment with a first horizontal component of movement in a first direction across the sliding surface and a second path segment with an upward vertical component of movement and a second horizontal component of movement in a second direction across the sliding surface opposite to the first horizontal direction.

In some embodiments the sliding surface is open sided.

In some embodiments the sliding surface is concavely curved about three axes.

In some embodiments the sliding surface is at least a portion of a sphere, an ellipsoid, an ovoid, a paraboloid or a bowl shape.

In some embodiments the sliding surface comprises at least a portion of a cone.

In some embodiments the water slide feature is open topped.

In some embodiments the water slide feature is partially enclosed.

In some embodiments the water slide feature is a substantially complete sphere, ellipsoid, or paraboloid.

In some embodiments the sliding surface has a diameter of between about 10 and 150 feet.

In some embodiments the sliding surface is a hemisphere with a horizontal open side In some embodiments the sliding surface has an open side that is angled to the horizontal between 0 and 90 degrees.

In some embodiments, the water slide feature further comprises at least one opening about which the riders and/or ride vehicles travel.

In some embodiments, the water slide feature further comprises an entry and an exit wherein the exit crosses under the entry.

In some embodiments, the water slide feature further comprises an entry and an exit wherein the ride path crosses under the entry.

In some embodiments, the water slide feature further comprises and entry and an exit wherein the entry comprises a flume ride.

In some embodiments, the water slide feature further comprises an exit wherein the exit is at a low point of the sliding surface.

In some embodiments, the water slide feature further comprises a barrier adjacent the exit.

In some embodiments, the water slide feature further comprises a barrier for retaining water adjacent the exit.

In some embodiments the barrier comprises a stopping pool adapted to allow the rider to stand and exit.

In some embodiments, the water slide feature further comprises an entry and an exit wherein both the entry and the exit are above a low portion of the sliding surface.

In some embodiments the exit is adjacent to the top of the sliding surface.

BRIEF DESCRIPTION OF THE DRAWINGS

Embodiments will now be described with reference to the attached drawings in which.

DETAILED DESCRIPTION

Figure 1:
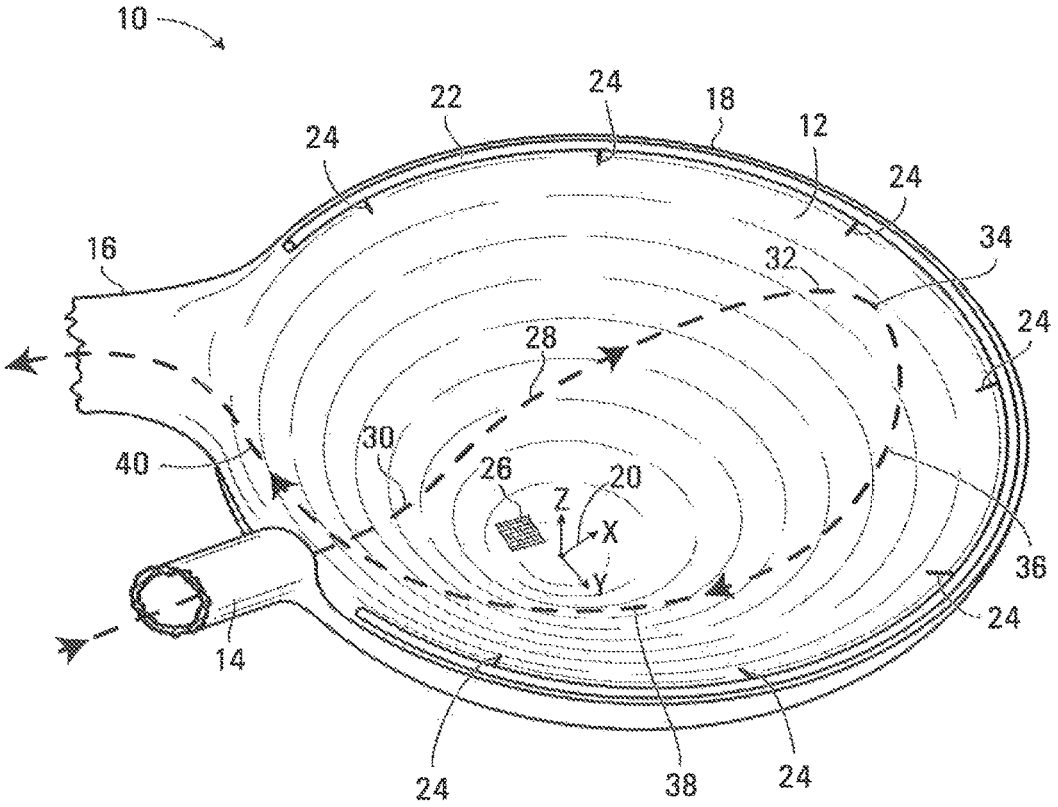
FIG. 1 is a perspective view of a water slide according to a first embodiment.

FIG. 1 depicts a water slide 10 in accordance with a first embodiment. Water slide 10 includes a sliding surface 12, an entry 14 to the sliding surface 12 and an exit 16 from the sliding surface 12.

In this embodiment, the sliding surface 12 has a shape that is based on the inside surface of one half of an approximate sphere. The sliding surface 12 has an edge 18 and center point 20, from which the sliding surface 12 curves outward. In this embodiment, the center point 20 is the approximate geometric center of the sliding surface 12. The bowl shape sliding surface 12 is approximately symmetrical about the center point 20, although the edge 18 may be angled in any direction relative to level ground. This means that the center point 20 may be the lowest point of the sliding surface 12 if the edge 18 is parallel to level ground. The center point 20 will not be the lowest point of the sliding surface 12 if the edge 18 is not parallel to level ground.

The edge 18 may include a lip or small wall that projects outwardly over the sliding surface 12. Such a lip or small wall can provide a safety feature for the sliding surface 12 by preventing riders, ride vehicles or water from traveling beyond the edge 18.

In this embodiment, adjacent to the edge 18 is a water supply conduit 22. The water supply conduit includes a number or nozzles, holes or perforations 24. The water supply conduit is connected to a source of water (not shown). The water supply conduit 22 is used to circulate water through the water slide 10 and spray water onto the sliding surface 12 through the nozzles 24 to maintain at least part of the sliding surface 12 lubricated with water. The water is pumped to the sliding surface 12 through the water supply conduit 22 and out through the nozzles 24. The water then flows down the sliding surface 12.

The sliding surface 12 may include a drain 26 through which water can drain out of the water slide 10 and be recirculated back to the water slide conduit 22 and nozzles 24 so that water can be reused in the ride. Water may be introduced and drained by other means. For example, there may be openings across the sliding surface 12 to allow water to be introduced to and/or drained from the sliding surface 12. The water may also be sprayed onto the sliding surface 12 from an external source such as a sprayer overhanging the waterslide 10. Other lubricants may also be used or the use of water or other lubricants may be eliminated. For example, if the sliding surface 12 and the bottom of a ride vehicle are formed of or coated with an appropriate material, such as teflon™, the use of a lubricant may be unnecessary. The lubricant may also be coated on the bottom of or sprayed from the riding vehicle or rider.

The entry 14 in this embodiment is a flame which can be either open or closed. Other embodiments may include entering from other water slides or a rider and/or ride vehicle starting the ride by entering the sliding surface by a platform, stairs or other means to climb to the edge 18 and start riding from that point. In some embodiments, the entry may be through the side of the water slide 10 rather than over the edge 18. In this embodiment, the entry 14 directs the rider initially in an angled downward direction as the rider enters the sliding surface 12. The path of the rider will be discussed in further detail below.

The exit 16 of this embodiment is also along the edge 18 of the water slide 10. In this embodiment, the exit 16 is a flume (either open or enclosed), which is adjacent to but spaced apart from the entry 14 along the edge 18. The exit may have a wide opening to enable riders on a variety of ride paths to exit. The location and shape of the entry 14 and the exit 16 may be varied depending on the size and shape of the sliding surface 12 and the coefficient friction of the rider on the sliding surface 12.

The sliding surface 12 of this embodiment, as noted above, is generally in the shape of the inside of one half of a sphere. For ease of reference, three mutually orthogonal positive axes or directions X, Y and Z have been marked at the center point 20. The negative axes or directions are opposite to these axes. The sliding surface 12 in this embodiment is oriented such that the center point 20 is the lowest point of the sliding surface relative to level ground. The edge 18 is parallel to level ground. The planed defined by the X and Y axes is parallel to solid ground. The Z axis is perpendicular to solid ground, oriented upward, parallel but opposite to the direction of gravity. It will be appreciated that the sliding surface is curved inward or concave relative to all three of the X, Y and Z axes such that the sliding surface is concave about three axes.

In this embodiment, the sliding surface is smooth and open-sided such that the rider can potentially ride over any part of the sliding surface 12. This is in contract to a flume ride which includes walls or channels to guide the rider along a predetermined path. In the water slide 10, for at least a portion of the ride experience, the path of the rider is not predetermined by walls or channels on the sliding surface 12.

The sliding path 28 is an exemplary sliding path which a rider might travel on the water slide 10. The exemplary sliding path 29 is described below to provide an exemplary description of a ride path that a rider might travel when the water slide 10 is symmetrical about level ground with the Z axis parallel to the direction of gravity. The ride directions are for clarity of explanation only and do not limit the ride path to a particular direction. The sliding path 28 can be broken down into a number of segments 30, 32, 36, 38 and 40.

When the rider enters the sliding surface 12 from the entry 14, the rider has a certain velocity and direction of travel. In the first segment 30 of the sliding path 28, the rider may come out of the entry 14 and may be directed downward to move in a negative Z direction, partially horizontally in a positive X direction, and partially horizontally in a negative Y direction across the sliding surface 12. The momentum of the rider may cause the rider to move up the far side of the sliding surface 12 along a second segment 32 of the sliding path 28. Along the second segment 32 the rider may move upward in a positive Z direction, with partially horizontally in a positive X direction, and a component of movement partially horizontally in a positive Y direction across the sliding surface 12. In the transition from the segment 30 to the segment 32, the vertical Z component and the horizontal Y component of the direction of travel of the rider are reversed from positive to negative such that the rider moves upward back across the sliding surface 12.

The rider then moves into the third segment 36 of the sliding path 28. In the transition between the second segment 32 and the third segment 36, the rider may reach a certain vertical point 34 of travel. In this exemplary ride path 28, the vertical point 34 is the highest vertical assent of the rider. In the segment 36, the rider may move downward in a negative Z direction, partially horizontally in a negative X direction, and partially horizontally in a positive Y direction across the sliding surface 12. In the transition from the segment 32 to the segment 36, the vertical Z component of the direction of travel of the rider and the horizontal X component of the direction of travel of the rider are reversed such that the rider travels downward back towards the entry 14.

The segments 32 and 36 together can be seen as a loop, which, rather than sending the rider back along the path they have just taken when a highest vertical assent is reached, may send the rider across the face of sliding surface 12 with a continuing forward movement in the Y direction.

In the transition between the third segment 36 and the fourth segment 38 of the sliding path 28, the rider may reach a relatively low point of travel along the sliding surface 12 between the segments 36 and 38. The rider then moves into the fourth segment 38 as the rider moves upward in the positive Z direction, partially horizontally in a negative X direction, and partially horizontally in a negative Y direction across the sliding surface 12. In the transition from the segment 36 to the segment 38, the vertical Z component of the direction of travel of the rider and the horizontal Y component of the direction of travel of the rider are reversed.

In the fifth segment 40, the sliding path 28 crossed over the first segment 30 of the sliding path 28 completing a 360° loop, and the rider may travel upward and out through the exit 16. It will be noted that the component of the movement of the rider in the direction of the X, Y and Z axes is never reversed for all three axes at the same time. The direction of movement, always remains the same for the X or Y axis. For example, in the transition from segment 30 to 32, the X component of movement remains in the positive direction and in the transition from segment 32 to 36, the Y component of movement remains in the positive direction.

It can be seen that one sliding path 28 of this embodiment describes a looping path in which the path loops around the center point 20 traveling up, over, back down, around and intersecting the original sliding path 28 before exiting the water slide. As can also be seen, the rider changes direction along the riding path 28 without necessarily ever having to transition through a period of low or near zero velocity. For example, although the rider may have a zero vertical or Z velocity at vertical high point 34, the rider will still be travelling in the X and/or Y directions and will have Z and/or Y velocity.

Although only half of a sphere is depicted in FIG. 1 it will be appreciative that, less than half a sphere can be used, more than half a sphere can be used, or a full sphere may be provided with the ride completely enclosed except for the entry 14 and the exit 16. The ride may contain lights or may be dark, depending on the desired effect. If a sphere or more than half of sphere is provided, the positioning of the water supply conduit 22 may be altered and the water supply conduit 22 or other water supply means may be from the outside of the sliding surface 12 and sprayed in through the sliding surface 12 such that the riders may slide over the water supply without altering their sliding experience.

Figure 2:
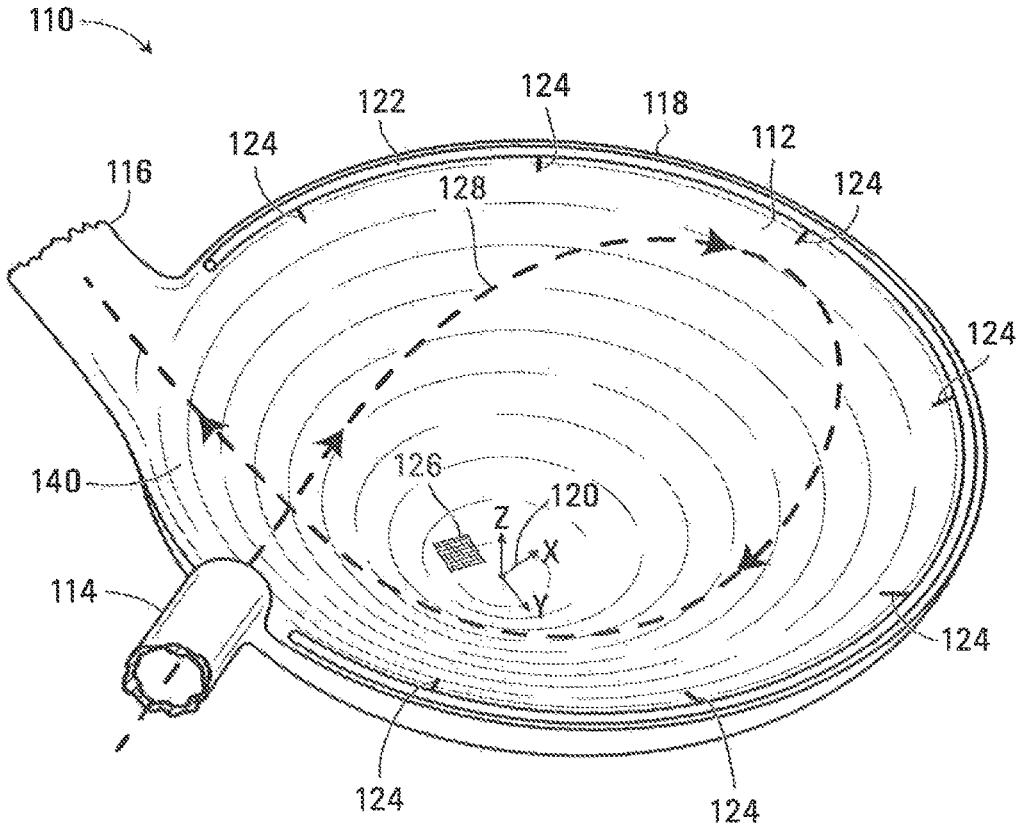
FIG. 2 is a perspective view of a water slide according to a second embodiment.

As previously noted, at least a portion of the path of the riders is non-predetermined. Instead, the path will be determined, at least partly, for example, by the mass of the rider or ride vehicle, their initial angle at which they enter the sliding surface 12 and their initial velocity. For example, FIG. 2 shows a water slide 110 which is similar to water slide 10 depicted in FIG. 1. Water slide 110 will be described only in respect of how it differs from water slide 10. The water slide 110 has a sliding surface 112, and entry 114 and an exit 116.

The difference between the water slide 110 and the water slide 10 is the difference in the downward angle and the X, Y direction and location of the entry 14 and the exit 16. As can be seen from comparing FIG. 1 and FIG. 2, the angle of the entry 114 in FIG. 2 is a shallower angle than the angle of the entry 14 in FIG. 1 such that the rider when entering from entry 14 in FIG. 1 may be directed more downwardly whereas the rider entering the sliding surface 112 from the entry 114 in FIG. 2 may be directed more laterally across the sliding surface 112. The rider of the water slide 110 may trace an exemplary sliding path 128 as shown in FIG. 2. It will be appreciated that the sliding path 128 may be different from the sliding path 28. However, there are commonalities between the two riding paths 28 and 128. For example, both riding paths may travel first downward from the entry and then upward, back across and then intersecting the original path such that the sliding paths 28 and 128 both trace a looping path across the sliding surfaces 12 and 112.

It can be appreciated that the change from the configuration of FIG. 1 to the configuration of FIG. 2 may not require completely different water slides and instead the entry 14 may be moveable to the position of the entry 114 and similarly the exit 16 may be moveable to the position of the exit 116 such that the water slide may be adapted to define a number of potential sliding paths in a single water slide 10. Alternatively, users may be given the option of multiple possible in runs, each providing a different ride experience.

Figure 3:
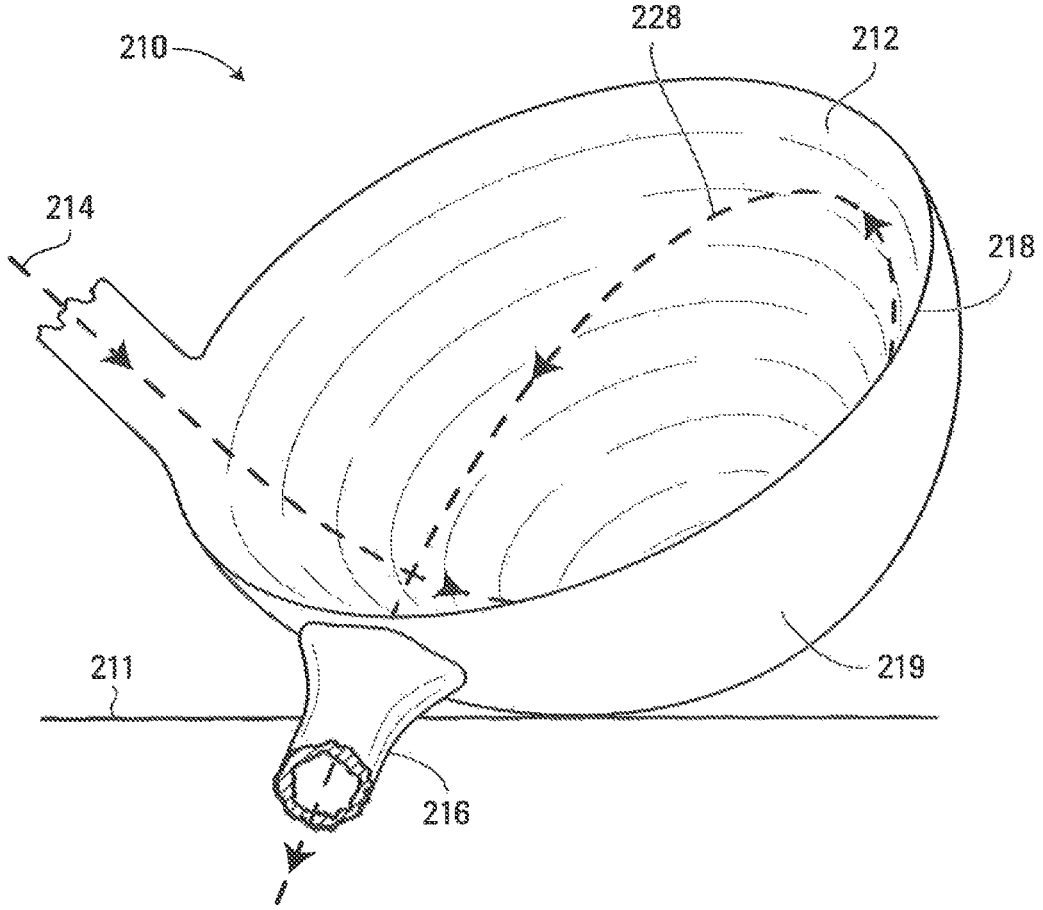
FIG. 3 is a perspective view of a water slide according to a third embodiment.

Numerous other shapes and configurations of sliding surfaces may be used. FIG. 3 shows a water slide 210 which is also based on an approximate half-sphere sliding surface. The water slide 210 differs from the water slides depicted in FIGS. 1 and 2 in several ways. The water slide 210 has a sliding surface 212, an entry 214, an exit 216 and an edge 218. The water slide 210 is shown as positioned relative to level ground 211. The distance between level ground 211 and the water slide 210 may be varied and the water slide 210 may or may not rest on the level ground 211.

The edge 218 of this embodiment may not be horizontal, i.e. parallel to the level ground 211. Instead, the edge 218 may be angled relative to the level ground 211. The entry 214 and the exit 216 may be positioned along the less elevated portion of the edge 218. Also, in this embodiment, the exit 216 may not be positioned at the edge 216. Instead, the exit 216 may be through a side wall 219 of the water slide 210. This means that the rider may not need to have the momentum the rider would need to ride up and over the edge 218 as might be required in the water slides of FIGS. 1 and 2. It will be appreciated that the exits 16 and 116 could be similarly positioned through a side wall rather than over the edges 18 and 118 of the waters slides 10 and 110. The entry 214 of the water slide 210 may be positioned at a steep enough angle so that the rider or ride vehicle travelling along the sliding path 228 may have sufficient momentum to travel up and around the looping path and out through the exit 216 as shown in FIG. 3.

As with FIGS. 1 and 2, in this embodiment the rider or ride vehicle also travels a looping path. The angle of the edge 218 relative to the level ground 211, according to embodiments of the invention may vary anywhere from 0° to 90° or more. Depending on the angle chosen and the configuration of the slide surface and entry and exit, riders can be given the visual and physical sensation of travelling a hear-vertical loop, even though the path they travel may be actually angled relative to the vertical.

Figure 4:
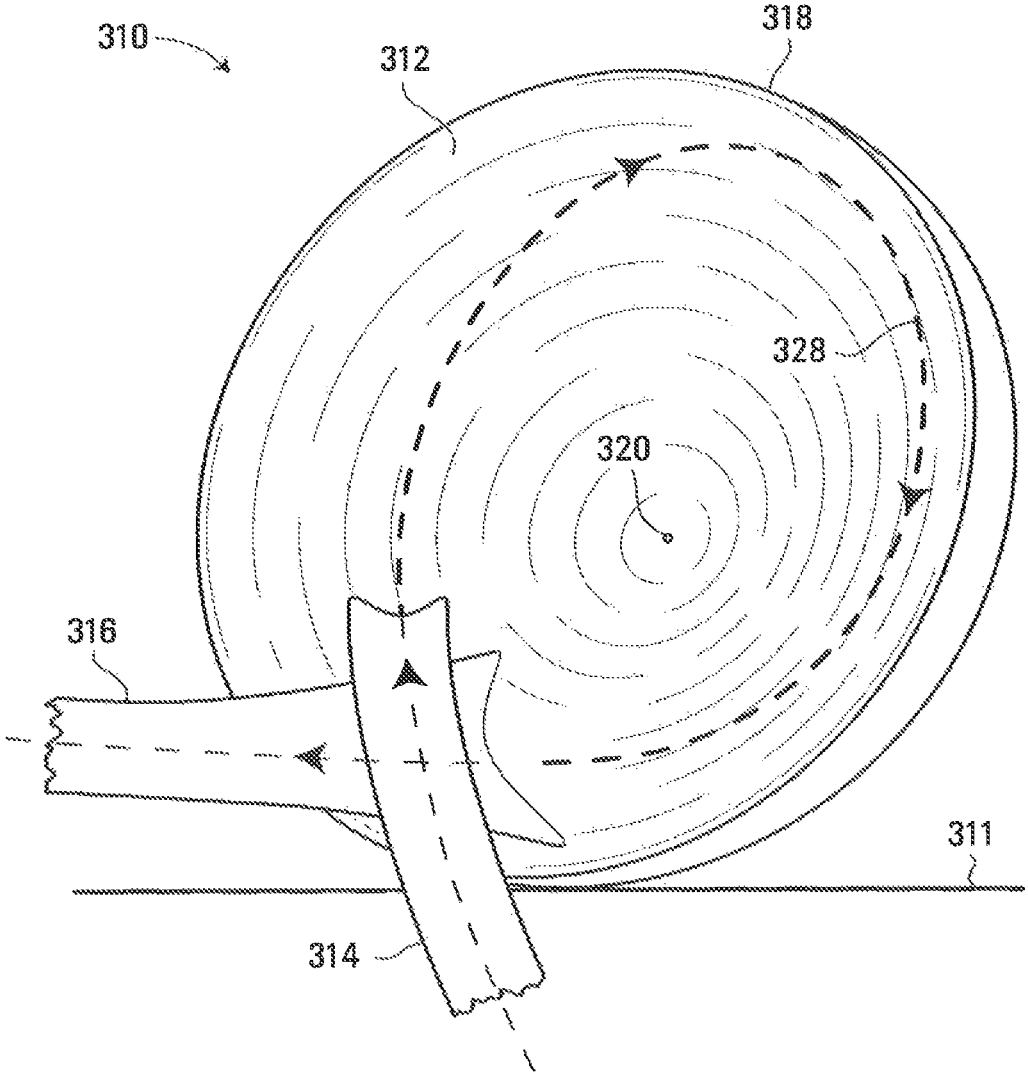
FIG. 4 is a perspective view of a water slide according to a fourth embodiment.

FIG. 4 shows a water slide 310 having a sliding surface 312, an edge 318, an inlet 314, an outlet 316, a center point 320 and a sliding path 328. As with the embodiments of FIGS. 1 to 3, the embodiment of FIG. 4 is based on a half sphere sliding surface 312 although other shapes could be used. In this embodiment, like the embodiment of FIG. 3, the edge 318 may be angled to level ground 311 with the entry 314 and the exit 316 being positioned adjacent the lowest point of the edge 318. In this embodiment, the entry 314 extends over the exit 316 such that the sliding path 328 does not cross itself on the sliding surface 312. Instead, the exit 316 is below the entry 314. The sliding path 328 still traces a looping path around center point 320 of the sliding surface 312. In other embodiments, neither the sliding path nor the entry and exit overlap. For example, the entry may be to the left of the exit in FIG. 4.

Figure 5:
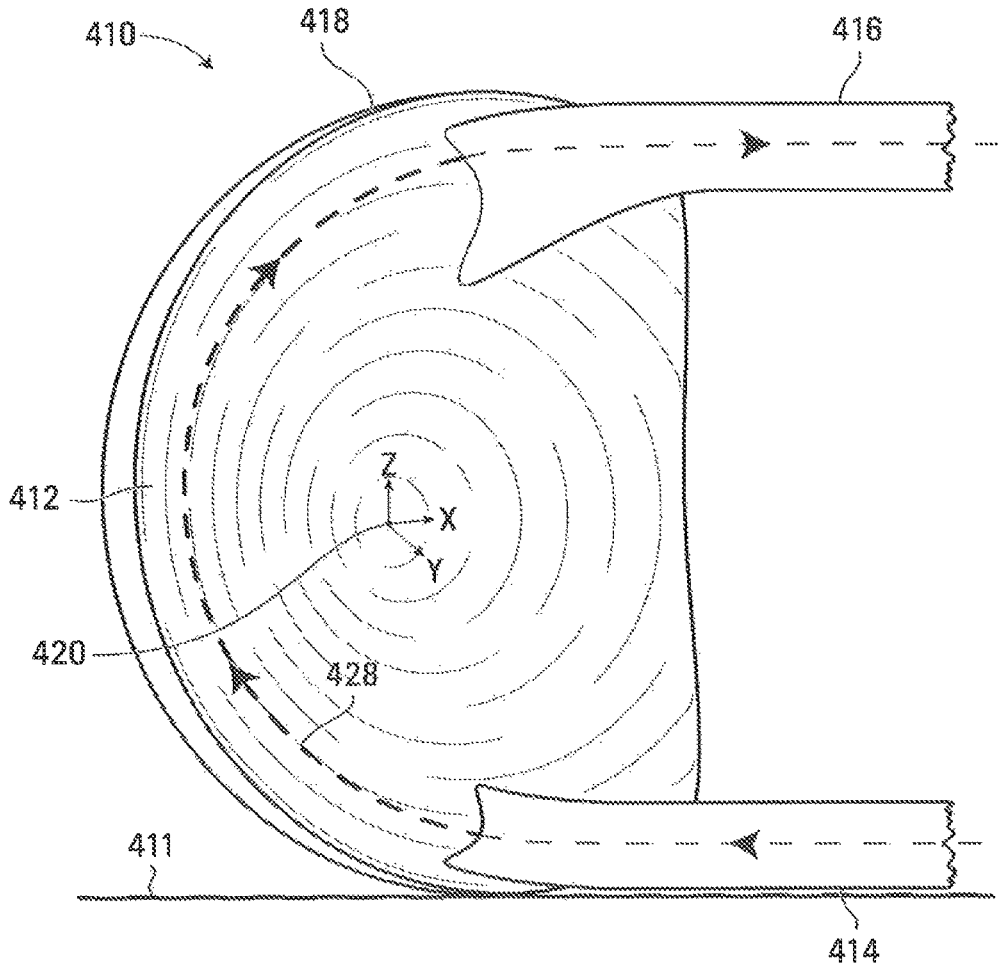
FIG. 5 is a perspective view of a water slide according to a fifth embodiment.

FIG. 5 shows another embodiment of the invention. In this embodiment, a water slide 410 includes a sliding surface 412, an edge 418, an entrance 414, an exit 416 and a sliding path 428. It can be seen that in this embodiment, the water slide 410 may not be a complete half-sphere. The water slide 410 may be formed from a portion of a half-sphere but not a complete half-sphere. The sliding path 428 in this embodiment may be shorter and, for example 180°, based on the positioning of the exit 416 relative to the entrance 414. In this embodiment, the entrance 414 is an enclose flume adjacent the low point of the edge 418 but the exit 416 is an enclosed flume adjacent the high point of the edge 418. This results in the sliding path 428 tracing a looping path only about one half of the looping path traced in the previously described embodiments. It will be understood that other path lengths traversing, for example, 240° are also contemplated. The X, Y and Z axes are marked on FIG. 5 at the center point 420 of the sliding surface 412. The remainder of the sliding surface 412 curves outwardly from center point 420. The Z axis is again vertical and the X and Y axes are orthogonal and defining a plane parallel to level ground. The X axis is parallel to the edge 418.

In the embodiment of FIG. 5, the rider first travels upward in a positive Z direction and horizontally in a negative X direction across the face of the sliding surface 412. The rider then continues to travel upwards but then travels a curve back in a positive X direction across the face of the sliding surface opposite to the X direction in which the rider is first travelling while still travelling upward. Notably, the rider in FIG. 5 changes direction to travel from a negative X direction to a positive X direction while still travelling in a substantially upwards Z direction the entire time.

The diameter of the water rides of this invention may vary greatly. The water rides may be anything having a circular diameter of e.g. 150 ft or more or be as small as e.g. 10 ft or less for a water slide attraction designed for young children or body sliding.

Figure 6A:
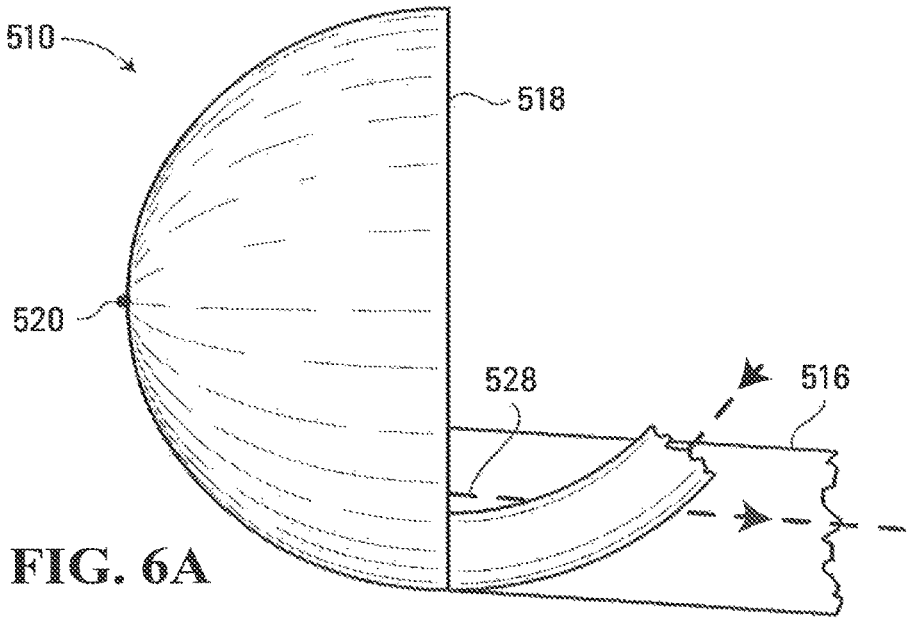
FIG. 6A is a side view of a water slide according to a sixth embodiment.
Figure 6B:
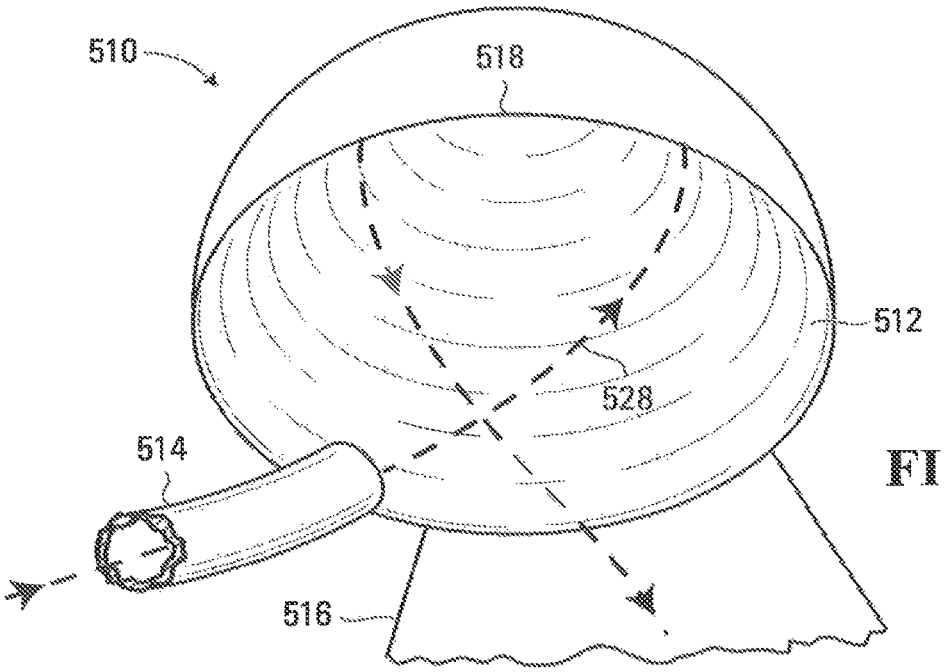
FIG. 6B is a perspective view of the water slide of FIG. 6A.

FIGS. 6A and 6B depict another embodiment which may be used either for large or small diameter rides. FIGS. 6A and 6B depict side and front perspective views of a water slide 510. The water slide 510 has a sliding surface 512, an entry 514, an exit 516, an edge 516 and a sliding path 528. The water slide 510 also has a geometric center point 520 of the sliding surface 512.

In this embodiment, the edge 518 is vertical. Sliding surface 512 is based on a half-sphere. In this embodiment, the sliding path 528 may or may not circle the center point 520 depending on, for example, the weight of the rider or riders, their weight distribution, their initial velocity and their entry angle. Sliding path 528 still traces a looping path in which the riders' horizontal movement may be reversed throughout the loop and the loop of the sliding path 528 may cross itself. In this embodiment, the rider may be directed through the entry 514 along the sliding path 528 and out through the exit 516.

In some embodiments, particularly if this water slide 510 is used for the young, the exit 516 may be a shallow stopping pool into which the rider drops or may be a wide run out area which will allow the rider to slow down, stop and then stand to exit. Similarly, the entry 517 may simply be fed by a body water slide which the rider climbs up to and then rides down and into the water slide 510.

The embodiments depicted in FIGS. 1 to 6B depict a sliding surface which has a curvature based on that of a portion of a sphere. However, embodiments are not limited to spherical sliding surfaces. Other embodiments encompass portions of ovoid, ellipsoid, paraboloid and other bowl-shaped sliding surfaces as well as irregular surfaces designed to achieve the same looping effect as described above.

Figure 7:
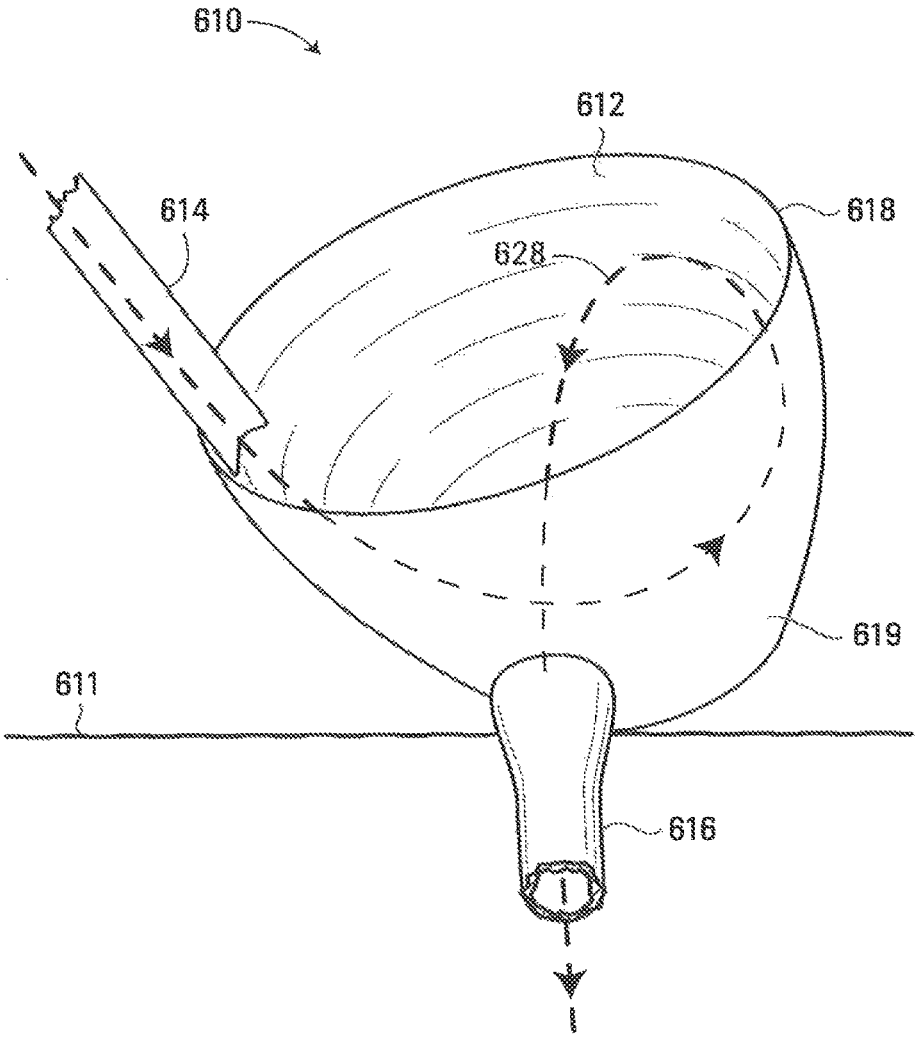
FIG. 7 is a perspective view of a water slide according to a seventh embodiment.
Figure 8:
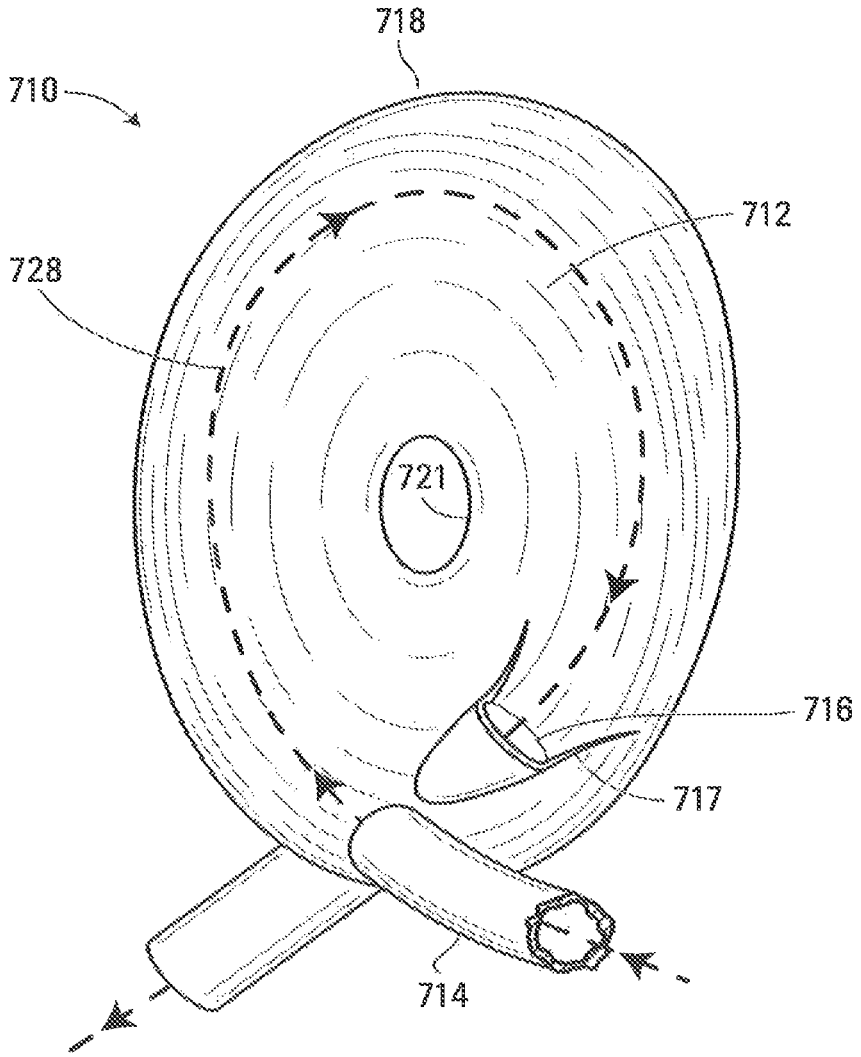
FIG. 8 is a perspective view of a water slide according to an eighth embodiment.

FIG. 7 depicts a water slide 610 having a sliding surface 612, an edge 618, a sidewall 619, an entrance 614 and an exit 616. A sliding path 628 is also shown. In this embodiment, the sliding surface 612 may not be defined by a portion of a sphere. Instead, the sliding surface 612 is a bowl-shape which may be roughly ellipsoid in shape.

The edge 618 of the sliding surface 612 is angled from level ground 611 toward the entrance 614. In other words, the axis of curvature of the sliding surface 612 may not be vertical, but rather angled relative to level ground 611. As noted above, the angle may vary anywhere from e.g. 0° to 90°. The entry 614 may be angled to direct the rider downwards along the sliding path 628 and then upwards around the far side of the sliding surface 612 and then back and out through an exit 616. In this embodiment, the exit 616 extends through the sidewall 619. In this embodiment, the sliding path 618 traces a complete cross-over loop where the sliding path 628 crosses over itself. As noted above, depending on where the exit is positioned, a shorter loop that does not cross over itself may be traced. Also, the sliding parts 628 may not encircle the lowest point or a center point of the sliding surface 612.

Although not present is all of the figures, it will be understood that the water slide feature according to embodiment of the invention may contain a water supply system for lubricating the sliding surface and recirculating the water through the water slide.

FIG. 2 depicts another embodiment of the invention. A water slide 710 is provided with an open-sided sliding surface 712, an inlet 714, and an outlet 716. A sliding path 728 is shown. In this embodiment, the sliding surface 712 is curved about three axes but is not necessarily a portion of a sphere or any other symmetrical shape. In this embodiment, the sliding surface 712 has both an outer edge 718 and an inner edge 721. The inner edge 721 may be a flattened, humped or otherwise shaped portion or may be an opening through the sliding surface 712. If it is an opening, a lip or small wall may encircle the inner edge 721. Similarly, the outer edge 718 may also include a lip, small wall or other barrier. However, the wall, lip or other contour which may be present at edges 718 and 721 do not substantially determine the slide paths of the rider. The path of the rider is substantially determined by the curvature of the sliding surface 712 as well as characteristics of the rider or vehicle such an weight and weight distribution, such that the path a rider or vehicle will travel over the surface 712 is non-predetermined and may vary from rider to rider.

In this embodiment, a rider rides out of the entry 714 up and around in a looping path similar to that defined in FIGS. 6A and 6B. In this embodiment, the sliding path 728 does not cross itself because there is an exit out through the sliding surface 712 to allow the rider out through the exit 716 and on to other ride destinations. The exit 716 may have a bearm, barrier or other protrusion 717 out from the sliding surface 712 to help prevent the riders from dropping through the exit 716 when travelling from the entry 714 onto the sliding surface 712 and/or help retain water adjacent the exit 716.

Figure 9A:
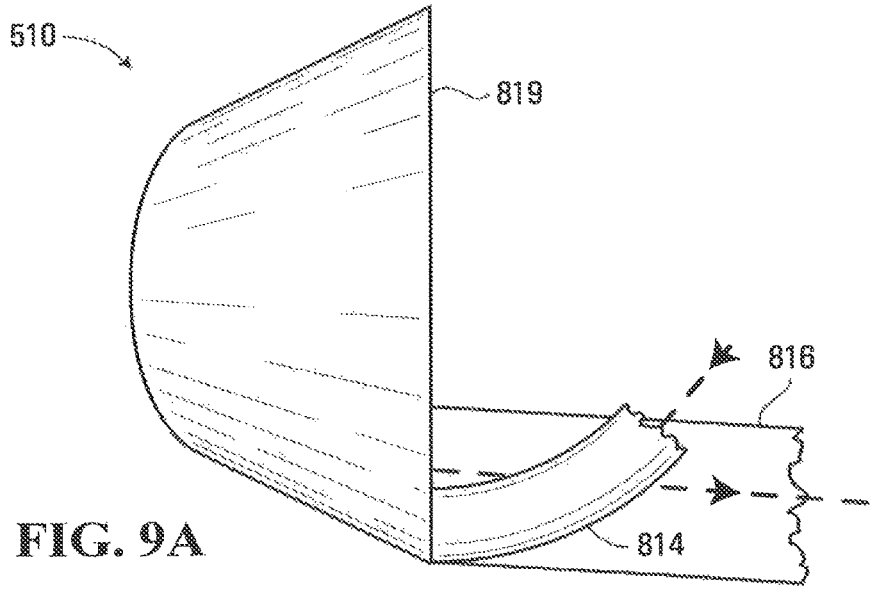
FIG. 9A is a side view of a water slide according to a ninth embodiment.
Figure 9B:
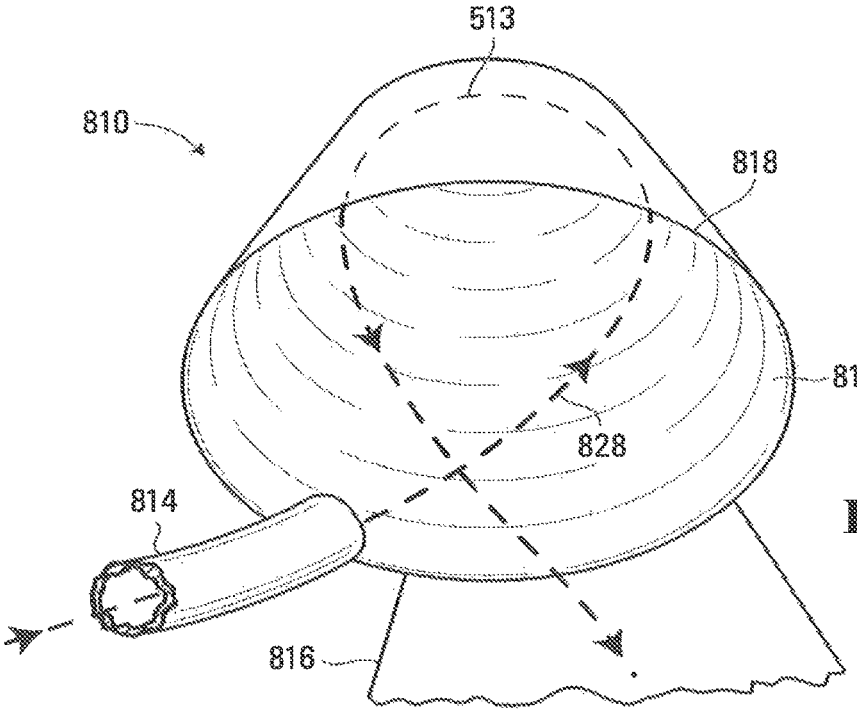
FIG. 9B is a perspective view of the water slide of FIG. 9A.

FIG. 9 depicts another embodiment in which the water slide 810 has a sliding surface 812. The sliding surface 812 of this embodiment may include a portion of a funnel shape at the entry/exit side but a bowl shape at the inward side. The embodiment is otherwise similar to the embodiment of FIG. 6A and 6B. In the embodiment of FIG. 9A, the rider enters from entry 814, travels a sliding path 828 upward around and back down and out through the exit 816.

The exit may have a wide mouth, for example, as wide as half the diameter of the sliding surface or more to allow for riders which travel different slide paths to exit.

The entry angle of the rider to level ground in the X, Y and Z directions and the entry velocity of the rider may affect the ride path as can be seen from a comparison of FIGS. 1 and 2.

Large circumference rides, e.g. of 40, 60, 100 or 150 feet, may be used with multi-person ride vehicles.

Numerous modifications and variations of the present invention are possible in light of the above teachings. It is therefore to be understood that within the scope of the appended claims, the invention may be practiced otherwise than as specifically described herein.

I claim:

1. A water slide feature comprising a spherical sliding surface adapted to carry one or more riders and/or ride vehicles sliding thereon from an entry to an exit, the entry sized and positioned to direct the one or more riders and/or ride vehicles along the sliding surface on a path which is at least partially upward and having a first path segment with a first horizontal component of movement in a first direction across the sliding surface and a second path segment with an upward vertical component of movement and a second horizontal component of movement in a second direction across the sliding surface opposite the first horizontal direction; and wherein the entry is substantially perpendicular to the sliding surface where the entry meets the sliding surface.

2. The waterslide feature of claim 1 wherein the entry is above the exit.

3. The waterslide feature of claim 2 wherein the entry is on a side of the sliding surface.

4. The waterslide feature of claim 3 wherein the exit is at a bottom of the sliding surface.

5. The waterslide feature of claim 3 wherein the exit is above a bottom of the sliding surface.

6. The waterslide feature of claim 5 wherein the entry is sized and positioned to direct the one or more riders and/or ride on a path which intersects itself on the sliding surface.

7. The waterslide feature of claim 1 wherein the entry is sized and positioned to direct the one or more riders and/or ride vehicles on a path which intersects itself on the sliding surface.

8. The waterslide feature of claim 1 wherein the entry is sized and positioned to direct the one or more riders and/or ride vehicles about a continuous path of at least 360 degrees about the sliding surface.

9. The waterslide feature of claim 1 wherein the waterslide feature is a substantially complete sphere.

10. The waterslide feature of claim 1 further comprising a barrier for retaining water adjacent the exit.

11. The waterslide feature of claim 1 wherein both the entry and the exit are above a low portion of the sliding surface.

12. A water slide feature comprising a spherical sliding surface adapted to carry one or more riders and/or ride vehicles sliding thereon from an entry to an exit, the entry sized and positioned to direct the one or more riders and/or ride vehicles along the sliding surface on a path at least partially upward; wherein the path is a continuous curved path of substantially 180 degrees; wherein the entry is substantially parallel to the exit; and wherein the entry and exit are on opposite sides of the sliding surface.

13. The waterslide feature of claim 12 wherein the entry and the exit are at substantially the same height.

14. The waterslide feature of claim 12 wherein both the entry and the exit are above a low portion of the sliding surface.

15. The waterslide feature of claim 12 wherein the waterslide feature is a substantially complete sphere.

* * * * *